United States Patent [19]

Decaux

[11] 4,205,801

[45] Jun. 3, 1980

[54] DEVICE FOR WINDING A BAND, IN PARTICULAR FOR A POSTER BOARD HAVING MOVING POSTERS

[76] Inventor: Jean-Claude Decaux, 53 Av. du Mal Lyautey, 75016 Paris, France

[21] Appl. No.: 972,077

[22] Filed: Dec. 22, 1978

[30] Foreign Application Priority Data

Dec. 29, 1977 [FR] France ..... 77 39575

[51] Int. Cl.[2] ..... B65H 17/02

[52] U.S. Cl. ..... 242/67.4; 40/471

[58] Field of Search ..... 242/67.1 R, 67.4, 75; 40/471, 472

[56] References Cited

U.S. PATENT DOCUMENTS

| | | | |
|---|---|---|---|
| 1,806,160 | 5/1931 | Graham | 40/471 |
| 3,007,100 | 10/1961 | Bettcher | 40/471 X |
| 3,145,943 | 8/1964 | Grant | 242/67.4 |
| 4,015,792 | 4/1977 | Thenon | 242/67.4 |

*Primary Examiner*—Edward J. McCarthy

*Attorney, Agent, or Firm*—Spensley, Horn, Jubas & Lubitz

[57] ABSTRACT

This device is of the type comprising a frame and two rollers which are mounted to rotate on the frame, about parallel axes. The band is fixed at both ends to the rollers. Means for driving in rotation at least one of the rollers and means for regulating the tension of the band between the rollers are provided. The means for driving in rotation are constantly engaged with the corresponding roller and means for regulating the tension of the band are means for relaxing the tension of the active part of the driving means and means for simultaneously increasing the tension of the passive part of the driving means.

6 Claims, 2 Drawing Figures

Figure 1:
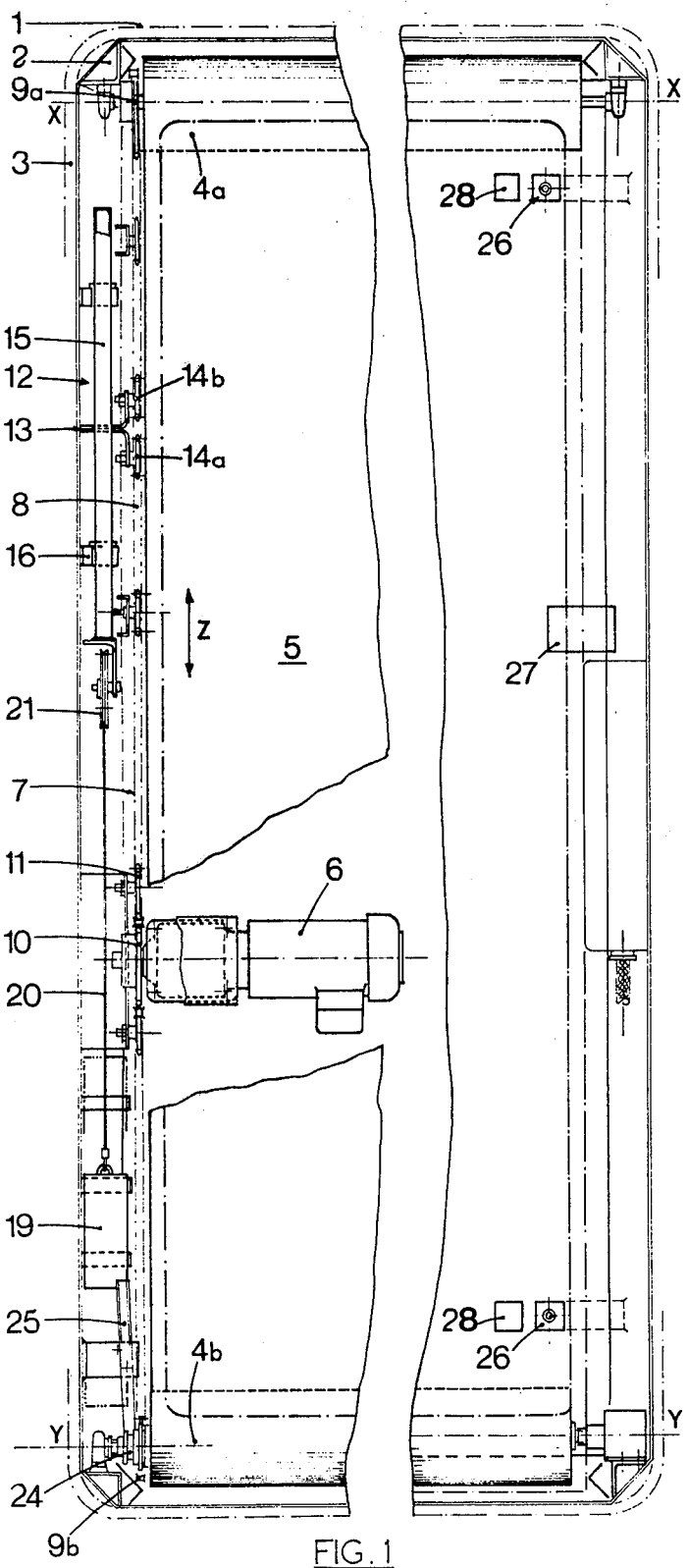

DEVICE FOR WINDING A BAND, IN PARTICULAR FOR A POSTER BOARD HAVING MOVING POSTERS

The present invention relates to devices for winding a band from a roller onto another roller, of the type comprising a frame on which the two rollers are mounted to rotate about axes which are roughly parallel to each other and are spaced a fixed distance apart, the band being fixed by its ends to these two rollers, a flexible transmission element providing a slip-free connection between the two rollers, means for limiting the tension of the band between the two rollers comprising a loop of variable length which passes around movable direction changing means on which act means for applying a roughly constant force, said loop being orientated in such manner that the force-applying means tend to elongate it, and means for driving in rotation the assembly comprising the band and the two rollers.

With this arrangement, an even tension of the band is achieved notwithstanding the accumulation of the latter on the receiving roller, which accumulation results in an increase in the diameter of the wound part and an increase in the peripheral or linear velocity of the latter, whereas the driving angular velocity is constant. In the absence of said limiting means, the increase in diameter of the wound part would result in an increase in the tension of the band in the course of the winding and create unacceptable danger of breaking or stretching the band.

Devices of this type are known, for example from French Pat. Nos. 73 18 209 (2,205,243) and N° 700 291, which employ different arrangements as concerns the disposition of the loop of variable length.

In the first case (French Pat. N° 73 18 209), the loop of variable length is provided directly on the band to be wound, the direction changing means comprising an intermediate roller on which the constant force-applying means acts, formed here by the weight of the intermediate roller or by a spring. This arrangement is hardly advantageous in as much as the device is relatively unreliable and the band is liable to deteriorate or even tear, after a prolonged operation.

In the second case (French Pat. No. 700,291), a loop of variable length is provided on a flexible transmission element. This arrangement improves the reliability of the device somewhat and reduces the risk of deterioration of the band.

However, in this device the driving of the assembly comprising the band and the two rollers is effected through an extremely complex mechanism comprising guides, slideways, levers, and links driven by a driving motor. The very complexity of this mechanism considerably increases the risk of jamming, wear, or in a general way, bad operation which renders the device of relatively little interest. Further, owing to its complexity, this mechanism has a considerable overall size which is distinctly larger than the rest of the device.

Further, owing to the nature of the aforementioned mechanism, there must be provided in the considered device means for maintaining the tension constituted by other means for applying a constant force, which is less than the force, exerted by the first means. As a result of this structure, which involves lack of symmetry between the two force-applying means, the tension limiting means only act effectively for a single direction of displacement of the band.

Consequently, the object of the present invention is to provide a device which has none of the aforementioned drawbacks and is in particular fully reliable as concerns the regulation of the tension of the band.

According to the invention, there is provided a device of the aforementioned type, wherein, in the case where the loop of variable length is provided on the flexible transmission element, the driving motor directly drives this flexible element.

Thus, owing to this arrangement, no complex and space-consuming drive mechanism is necessary, which renders the device fully reliable.

Further, the fact that the driving motor directly drives the flexible element enables the motor itself to perform the function of maintaining the drive tension of this flexible element so that special means are no longer required for this purpose.

Consequently, in a particularly advantageous embodiment of the invention, it is possible to arrange that, in the case where the said flexible transmission element is formed by one of the portions of an endless transmission element, the other end of which also comprises a loop of variable length passing around a second movable direction changing means, the two movable return means be carried by a common support element which is movable in the direction between the two rollers and on which act said roughly constant force-applying means, whereas the driving motor is formed by a reversible motor.

In this way, there is provided a device which maintains a constant band tension irrespective of the direction of displacement of the band and has minimum overall size.

In the preferred embodiment, a mechanical declutching or uncoupling means is inserted in the transmission in the region of one of the two rollers for use when the device is stationary. This permits the reduction of the tension of the band for operations such as when the device is stationary during servicing. Also advantageously, a safety switch may be disposed in the lower part of the travel of the weight, this switch being part of the circuit controlling the driving means for the roller or rollers. Also, preferably, the weight is suspended from a cable which passes around a pulley connected to the moving element, the free end of which is detachably connected to the lower part of the frame.

Generally, apart from the excellent reliability of the device as concerns the regulation of the tension of the band, the device has many other advantages, among which may be mentioned an excellent mechanical efficiency, since any friction which might exist in clutches and torque limiters is eliminated. Moreover, the transmission has a low inertia; consequently, the rate of unwinding may be considerably increased and, for example doubled, which prolongs the stationery period, and consequently the display of the poster, which is extremely important. Lastly, the system also compensates for relative expansions of the band and frame.

The invention is very advantageously applicable to poster boards having moving posters in which the device has a reversible movement. It is also applicable to advantage in many other fields, such as abrasive belts or protective films for lights or port-holes.

Figure 2:
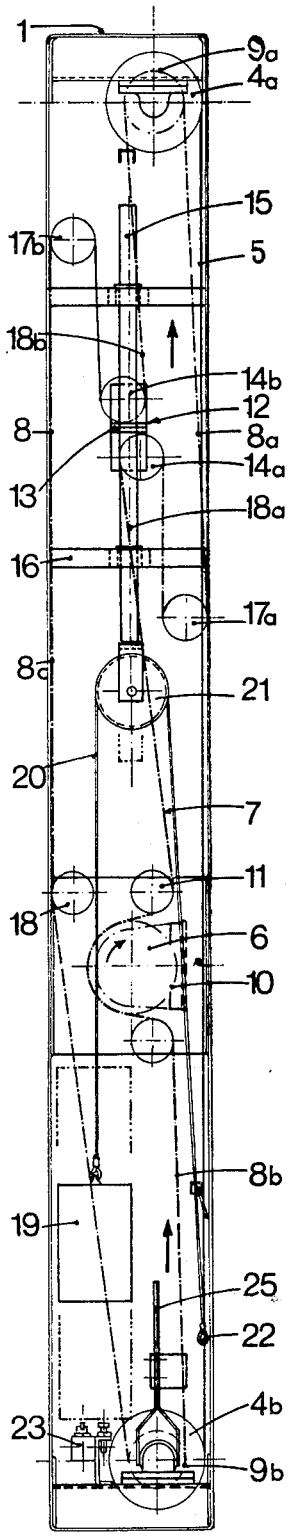

Further features and advantages of the invention will be apparent from the ensuing description which is given merely by way of example with reference to the accompanying drawing in which:

FIG. 1 is an elevational view, with a part cut away, of a moving poster board comprising a winding device according to the invention, and FIG. 2 is a view of this device as viewed from the left of FIG. 1, with the covering removed.

The illustrated poster board comprises a frame 1 having a generally rectangular-sided shape and including on one hand, a support framework 2 and, on the other hand, an outer cover 3. Mounted on this frame are two rollers, 4*a* and 4*b*, which are rotatable about horizontal parallel axes X—X and Y—Y contained in a vertical plane. These rollers receive a band 5 formed by a sequence of posters which are connected to each other, this band being connected at its ends respectively to the two rollers 4*a* and 4*b* around which it is wound. The band is held taut between the two rollers.

In addition to the frame 1 and the two rollers 4*a* and 4*b*, the presently described winding device comprises means for driving the two rollers in rotation which are constantly engaged-driving means which comprising a reversible motor-speed reducer unit 6 and a transmission 7 directly engaging the two rollers. The transmission 7 is located in the frame 1 on the left side relative to the part containing the band 5 whereas the motor-speed reducer unit 6 is located behind this band 5 in an intermediate position between the two rollers.

The transmission 7 comprises an endless loop chain 8 which passes around two spocket 9*a* and 9*b* which are keyed on the end of the shafts of the rollers 4*a* and 4*b* and a sprocket wheel 10 keyed on the end of the shaft of the motor-speed reducer unit 6. Two direction-changing sprocket wheels 11 facilitate the engagement of the chain with the sprocket wheel 10.

The winding device also contains a means for regulating the tension of the band between the two rollers. It comprises a means for relaxing the tension of the active part of the driving means and for simultaneously increasing the tension of the passive part of these means. The active part is formed by a portion of the chain, for example 8*b*–8*c*, which connects the driving sprocket wheel 10 to the sprocket wheel; for example 9*a*, associated with the receiving roller 4*a*, thereby subjecting the this portion of the chain to a tension. The passive part is formed by the other portion of the chain 8*a* which connects the driving sprocket wheel 10 to the sprocket wheel 9*a*.

Consequently, it will be assumed that, in this mode of operation, the band 5 travels upwardly as it is unwound from the roller 4*b* and wound around the roller 4*a*. It will be understood that, by reversing the operation of the motor speed reducer unit 6, the band can also be driven downwardly in the opposite direction.

The considered means for simultaneously relaxing and increasing the tension comprises an element 12 which is mounted to be movable in the direction Z between the roller 4*a* and the roller 4*b*. This element 12 is formed by a carriage comprising a T-shaped support 13 the two vertical arms of which carry the spindles of two direction-changing means or sprocket wheels 14*a* and 14*b*. This support 13 is fixed to the middle of a vertical guide rod 15 the ends of which are slidably mounted in supports 16 secured to the frame. The two sprocket wheels 14*a* and 14*b* are engaged respectively with each of the two portions of the chain 8 which interconnect the sprocket wheels of the roller 9*a* and 9*b*. The first portion, or front portion, is formed by the assembly of the aforementioned two portions 8*a* and 8*b*. The second, or rear portion, is formed by another portion 8*c* of the chain which interconnects the rollers 9*a* and 9*b* without passing around the driving sprocket wheel 10. More precisely, the portion 8*a* has an S-shape and passes in succession around the driving sprocket wheel 10, around the direction-changing sprocket wheel 14*a* of the carriage 13, around another direction-changing sprocket wheel 17*a*, and then around the sprocket wheel 9*a*. Likewise, the rear protion 8*c* also has an S-shape and passes in succession around the sprocket wheel 9*a*, around the direction-changing sprocket wheel 14*b*, around another direction-changing sprocket wheel 17*b*, and then around the roller 9*b* with interposition of a path-changing roller 18 located roughly at the level of the driving sprocket wheel 10 and spaced from the latter.

Consequently, the two loops 18*a* and 18*b* which are formed by the portions 8*a* and 8*c* and pass around the sprocket wheels 14*a* and 14*b* extend in opposite directions and towards each other so that a vertical displacement of the carriage 12 results in a simultaneous shortening of one of the loops and a corresponding lengthening of the other loop.

The means for simultaneously relaxing and increasing the tension constructed in this way is achieved by means of a roughly constant force in the direction Z. These means comprise a weight 19 suspended from one end of a cable 20 which passes around the groove of a pulley 21. The pulley 21 is freely rotatably mounted on the lower end of the rod 15 guiding the carriage. The other end of the cable 20 is detachably connected to a point 22 in the lower part of the frame.

The device is completed, in the lower part of the frame, by a safety micro-switch 23 which is inserted in the electric circuit controlling the motor-speed reducer unit 6 and a clutch mechanism 24 for disconnecting the sprocket wheel 9*b* from the roller 4*b* when the whole of the device is stationary. This mechanism is actuated by a lever 25. Note that this lever 25 and the hooking point 22 of the cable are directly accessible in the lower part of the frame, even when the poster-board has a high location.

Also provided are two mark-detectors 26 which are mounted on the frame in alignment with a marginal portion of the band 5 respectively in the vicinity of the rollers 4*a* and 4*b*. These detectors indicate the presence of marks between successive posters forming the band so as to break the electric circuit controlling the motor-speed reducer unit 6 and thereby immobilize the band for each successive poster. Also provided are means 27 for controlling the lateral displacement of the poster. These means are disposed half-way up the band 5 on each side and in the vicinity of the edges of the band so as to maintain the band 5 in a suitably aligned position.

The device just described operates in the following manner: This device is designed to wind the band 5 alternately onto either of the two rollers 4*a* and 4*b*. The direction of winding is determined by the direction of operation of the motor-speed reducer unit 6. The reverse operation of the latter is achieved by reverse operation detectors 28 which are similar to the detectors 26 and have a similar position to the latter.

As the band is unwound from one of the rollers, for example roller 4*b*, and is wound onto the other roller 4*a*, the diameter of the part wound onto this roller 4*a* increases while the diameter of the part on the roller 4*b* decreases. The transmission 7 is directly engaged with no interposition of a disconnecting clutch or torque limiter, and the two rollers are driven by the driving sprocket wheel 10 at exactly the same angular velocity. As the diameter of these rollers change, there is a difference in the peripheral or linear velocity of the parts of the band being wound or unwound so that this would normally result in an increase in the tension of the band on the receiving roller 4*a* with corresponding danger of breaking or stretching of the band. However, owing to the presence of the means 12–19 for simultaneously relaxing and increasing the tension, there is a compensating effect brought about by an automatic displacement of the carriage 13, downwardly if it is the roller 4*a* which is the receiving roller, or upwardly in the opposite case.

Consequently, this device ensures a perfect regulation of the tension of the band 5. This tension is set at a value which is determined by choosing a suitable value of the weight 19. Indeed, if "d9" represents the diameter of the sprocket wheels 9*a* and 9*b* and "d4" the diameter of the rellers 4*a* and 4*b*, there is the following relation between the tension of the poster and the weight P:

$$T = Tc \times (d9/d4) \simeq k \times Tc \simeq k \times P$$

in which k is a constant, the last equality resulting from the fact that the value P of the weight is roughly equal to the force Tc on the chain.

Note that the switch 23 enables the device to be put out of action if the weight 19 travels beyond the normal lower limit of its travel or if the cable 20 breaks, whereas the declutching mechanism 24 permits, when the device is stationary, placing the poster band in a different position in which case the rollers rotate freely.

I claim:

1. A device for winding a band from a roller onto another roller, of the type comprising a frame on which the two rollers are mounted to be rotatable about axes which are substantially parallel and are spaced a fixed distance apart, the band being fixed at its ends to said two rollers, a flexible transmission element providing a slip-free connection between the two rollers a direction, changing means movably mounted on the frame, means associated with the direction changing means for applying a substantially constant force on the direction changing means, means for limiting the tension of the band between the two rollers and comprising a flexible loop element of the flexible transmission of variable length passing around the direction changing means, said loop being so oriented that said force applying means acting on the direction changing means tend to lengthen the loop, and a motor directly engaging the flexible element for driving an assembly comprising the band and the two rollers.

2. A device as claimed in claim 1, wherein said flexible transmission element comprises a first portion of an endless transmission element which has a second portion which has a second loop of variable length, said device further comprising a second movable direction changing means around which second direction changing means the second loop of the endless transmission element extends a support element carrying the two direction changing means and movable in a direction parallel to a plane containing the two rollers and on which support element said means for applying a substantially constant force act, the driving motor being a reversible motor.

3. A device as claimed in claim 2, wherein the plane containing the two rollers is vertical and the means for applying a substantially constant force comprise a weight and each of said two portions of the endless transmission element passes around a fixed direction changing means.

4. A device as claimed in claim 3, comprising a circuit controlling the driving motor and a safety switch inserted in said circuit, the weight travelling in a given path and the switch being located in a lower part of said path to be opened by the weight.

5. A device as claimed in claim 3, wherein the weight is suspended from a cable which passes around a pulley mounted on the movable support element, the cable having a free and detachably fixed to a lower part of the frame.

6. A device as claimed in claim 1, comprising mechanical disconnective means for use when the device is stationary, said disconnective means being inserted between the flexible transmission element and one of the two rollers.

* * * * *